United States Patent [19]

Datis

[11] 4,134,271

[45] Jan. 16, 1979

[54] VAPOR COLLECTION AND DISPOSAL SYSTEM

[76] Inventor: Angelo P. Datis, 16921 S. Western Ave., Gardena, Calif. 90249

[21] Appl. No.: 784,930

[22] Filed: Apr. 5, 1977

[51] Int. Cl.[2] ..... F17C 7/02

[52] U.S. Cl. ..... 62/54; 55/89; 220/85 VS; 431/5

[58] Field of Search ..... 55/88, 89; 62/54; 220/85 VR, 85 VS; 431/5

[56] References Cited

U.S. PATENT DOCUMENTS

| | | | |
|---|---|---|---|
| 2,640,627 | 6/1953 | Doelter | 62/54 |
| 2,682,154 | 6/1954 | Wilkinson | 62/54 |
| 3,672,180 | 6/1972 | Davis | 62/54 |
| 3,999,936 | 12/1976 | Hasselmann | 431/5 |

*Primary Examiner*—Ronald C. Capossela
*Attorney, Agent, or Firm*—Lyon & Lyon

[57] ABSTRACT

There is disclosed an improved hydrocarbon vapor collection and disposal system consisting of a hydrocarbon vapor circulation loop disposed between a hydrocarbon vapor storage area and a vapor disposal unit such as an incinerator or a liquefication unit. The system is also provided with means for activating the disposal unit when hydrocarbon vapors are passed from the hydrocarbon liquid dispensing unit into the circulation loop.

6 Claims, 1 Drawing Figure

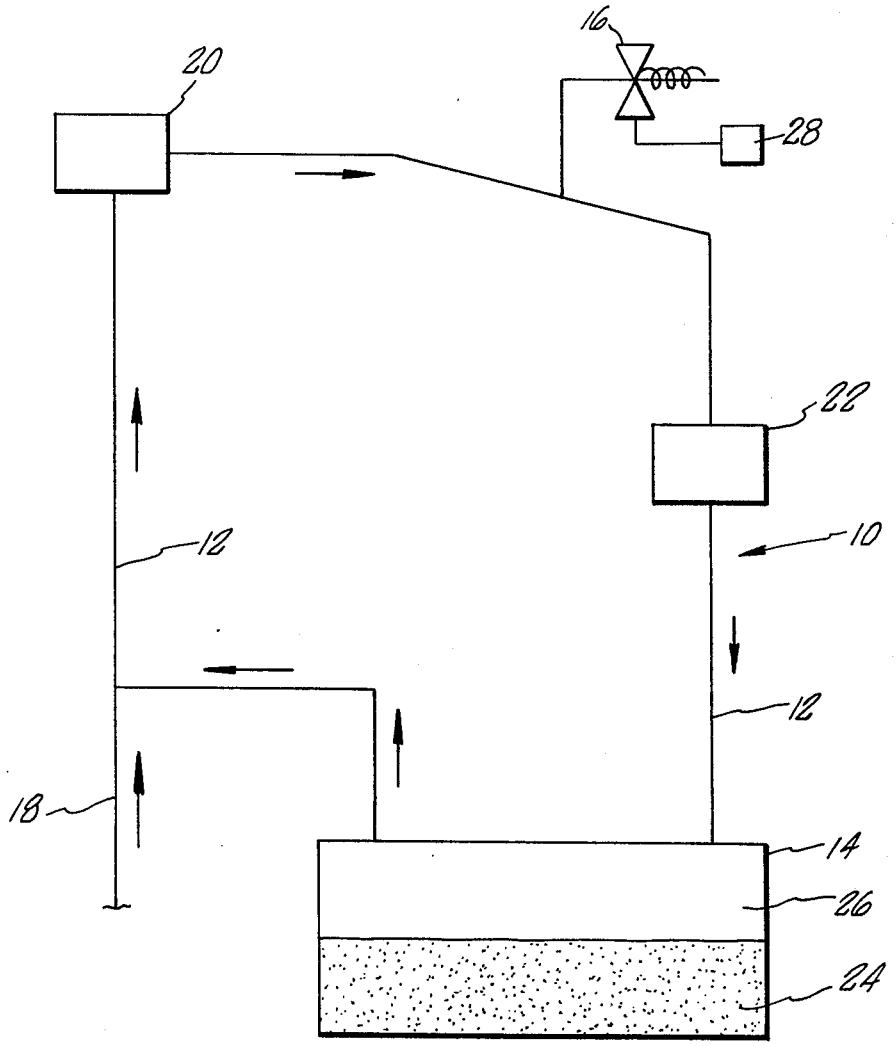
16
20
28
22
10
12
12
18
14
26
24

VAPOR COLLECTION AND DISPOSAL SYSTEM

BACKGROUND OF THE INVENTION

The present invention relates to a vapor collection and disposal system and in particular relates to a gasoline vapor collection and disposal system.

During the refueling of motor vehicles in most standard gasoline stations, a significant amount of gasoline vapors are released into the atmosphere. Since gasoline vapors commonly consist of photochemically reactive hydrocarbons, upon exposure to sunlight, the vapors react with the oxides of nitrogen in the air to form air pollution.

Most prior efforts to solve this problem have involved the collection and disposal of the gasoline vapors. The vapors were normally disposed of by combustion or liquefication by compression and refrigeration. Unfortunately, in most cases, the vapors collected during the refueling operations comprised hydrocarbons and ambient air. In some cases, this lean vapor mixture may be in the explosive range. Therefore, it was essential that the hydrocarbon content of the vapor mixture be increased prior to liquefication or combustion to avoid explosions which may occur with the combustion or liquefication of a lean mixture of the hydrocarbon vapors. Prior methods of processing the vapors to increase the hydrocarbon content and to avoid explosions have involved the storage of the collected vapors over liquid hydrocarbon fuel or in tanks filled with carbon. These methods have involved the use of expensive equipment such as refrigeration units, pressurizing units, carbon adsorption units, etc. and in some cases have also involved extensive modification of the gasoline piping system to enable pressurization or evacuation of the system. One prior method for the recovery of gasoline vapors is disclosed in the Datis U.S. Pat. No. 3,972,201, the disclosure of which is incorporated herein by reference.

Another prior method of collecting and disposing of gasoline vapors is disclosed in the Hasselmann U.S. Pat. No. 3,999,936. The method disclosed in Hasselmann involves collecting the lean gasoline vapor during refueling operations and storing these vapors in the liquid gasoline storage tank to insure that the vapors are rich in hydrocarbons prior to processing. Upon reaching a predetermined pressure, the gasoline vapors are removed from the storage tank and passed into an incinerator where they are burned off. Unfortunately, if the vapors are left undisturbed in the storage tank for a period of time, the vapors will tend to stratify with the heavier hydrocarbons forming the lower layer and the ambient air being forced into the upper layer. Since the design of the Hasselmann system inherently requires that the vapor be drawn off from the top of the storage tank, in cases where the vapors have been left undisturbed in the storage tank for a period of time, a lean mixture of hydrocarbon vapors are passed to the incinerator. In some cases, this lean mixture may contain an explosive mixture of hydrocarbons and air. Therefore, an improved system for the collection and disposal of gasoline vapors is still required.

SUMMARY OF THE INVENTION

It is therefore an object of the present invention to provide an improved apparatus and method for the collection and disposal of gasoline vapors.

This and other objects and advantages are obtained by forming an improved gasoline vapor collection and disposal system consisting of a hydrocarbon vapor circulation loop disposed between a hydrocarbon vapor storage area and a vapor disposal unit such as an incinerator or a liquefication unit. The system is also provided with an actuating means for activating the disposal unit when hydrocarbon vapors are passed from the hydrocarbon liquid dispensing unit into the circulation loop. The loop comprises a main conduit which is connected to a hydrocarbon vapor inlet, the disposal unit and the vapor storage area. The vapor inlet is in communication with the hydrocarbon liquid dispensing unit. The conduit is also preferably provided with a hydrocarbon vapor pumping means and a pressure regulator valve. During operation, the hydrocarbon vapors are continuously recirculated through the circulation loop. When the vapor inlet is closed and no hydrocarbon vapors are being introduced into the circulation loop, the vapors continuously flow through the main conduit from the storage area, to the pump, past the disposal unit and back to the storage area. The continuous circulation of the vapors prevents stratification and insures that the vapors flowing in the main conduit are rich in hydrocarbons. When the vapor inlet is open, hydrocarbon vapors from the liquid hydrocarbon dispensing unit are passed into the main conduit and mixed with the hydrocarbon vapors flowing therein to form a vapor mixture which is rich in hydrocarbons. The opening of the vapor inlet triggers the actuating means which activates the disposal unit. A portion of the hydrocarbon vapor mixture which is flowing through the main conduit is then passed into the disposal unit. The hydrocarbon vapor mixture which is passed into the disposal unit has a suitable concentration of hydrocarbon to enable its safe and efficient disposal.

BRIEF DESCRIPTION OF THE DRAWING

A more thorough disclosure of the objects and advantages of the present invention is presented in the detailed description which follows and from the accompanying drawing which is a schematic view of the invention.

DESCRIPTION OF PREFERRED EMBODIMENT OF THE INVENTION

The drawing illustrates the preferred embodiment of the hydrocarbon vapor collecting and disposing system according to the present invention. Referring to the drawing, the system comprises a circulation loop 10 which preferably comprises generally main conduit 12 disposed between the hydrocarbon storage tank 14 and incinerator liquification unit 16. The loop also preferably comprises a hydrocarbon vapor inlet 18, a hydrocarbon vapor pumping means 20, a pressure regulator valve 22, and an activating means 28. The storage tank is preferably provided with a hydrocarbon liquid space 24 and a hydrocarbon vapor space 26. The hydrocarbon vapors are drawn into the circulation loop 10 from hydrocarbon liquid dispensing stations (not shown) through vapor inlet 18.

During operation, the vapor pumping means 20 causes the hydrocarbon vapor to continuously circulate through the main conduit as shown by the arrows to substantially prevent stratification of the vapors. Any type of suitable vapor pump may be utilized in the practice of the present invention. Any suitable incinerator may also be utilized in the practice of the present invention.

During operation, when the vapor inlet is closed, the vapor pumping means causes vapor in loop 10 to continuously flow from the storage tank 14 through the main conduit 12, through the regulator valve 22 and back into the storage tank. The hydrocarbon vapor pumping means thus functions to continuously circulate the hydrocarbon vapor throughout the closed circulation loop 10 which substantially prevents stratification of the vapors in the storage tank and insures that the vapors are rich in hydrocarbons to enable their further processing.

When the vapor inlet 18 is opened, vapors which are collected from the liquid hydrocarbon dispensing unit are passed into the circulation loop 10 through inlet 18. These collected vapors are mixed with the vapors flowing in loop 10 and the mixture contains an adequate concentration of hydrocarbons to enable the mixture to be passed directly into the disposal unit. The opening of the inlet 18 also functions to trigger the actuating means to activate the incinerator 16. Thus, when vapor inlet 18 is opened, a portion of the hydrocarbon vapors flowing in conduit 12 are passed into the incinerator 16. The pressure regulator valve 22 maintains a backpressure in conduit 12 and regulates the amount of vapors which are passed into the incinerator. The vapors which are not passed into the incinerator pass through regulator valve 22 and continue to flow through loop 10.

When the vapor inlet 18 is closed, the valve actuating means deactivates the incinerator 16 and the vapors in conduit 12 continue to circulate through loop 10.

The system of the present invention enables collection and disposal of gasoline vapors without the need for expensive equipment or substantial modifications of existing systems. Further, the present invention insures that the hydrocarbon vapor which is delivered to the disposal unit has a sufficient concentration of hydrocarbons to enable safe and efficient disposal of the hydrocarbon vapors.

While an embodiment and application of this invention has been shown and described, it will be apparent to those skilled in the art that many more modifications are possible without departing from the inventive concepts herein described. The invention, therefore, is not to be restricted except as is necessary by the prior art and by the spirit of the appended claims.

I claim:

1. A device for increasing the concentration of hydrocarbons in a stream of lean hydrocarbon vapors prior to the disposal of said vapors comprising:

a circulation loop disposed between a liquid hydrocarbon storage tank and a disposal unit;

a vapor pumping means for pumping hydrocarbon vapors in said circulation loop;

a vapor inlet for introducing said lean vapors into said circulation loop; and means for activating said disposal unit only when said lean hydrocarbon vapors are passed into said circulation loop.

2. The system of claim 1 wherein said disposal unit is an incinerator.

3. The system of claim 1 wherein said disposal unit is a liquefication unit.

4. An improved method for increasing the concentration of hydrocarbons in a stream of lean hydrocarbon vapors prior to the disposal of said vapors comprising:

circulating rich hydrocarbon vapors in a circulation loop disposed between a liquid hydrocarbon storage tank and a disposal unit;

passing said lean vapors into said circulation loop and mixing said lean vapors with said rich vapors; and activating said disposal unit when said lean vapors are passed into said circulation loop.

5. The system of claim 4 wherein said disposal unit is an incinerator.

6. The system of claim 4 wherein said disposal unit is a liquification unit.

* * * * *